US008573741B2

(12) United States Patent
Sharan et al.

(10) Patent No.: US 8,573,741 B2
(45) Date of Patent: Nov. 5, 2013

(54) FLUID-EJECTION ASSEMBLY SUBSTRATE HAVING ROUNDED RIBS

(75) Inventors: Alok Sharan, Lake Oswego, OR (US); Thomas Novet, Corvallis, OR (US); Daniel W. Petersen, Philomath, OR (US); John Breen, Kildare (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 418 days.

(21) Appl. No.: 12/609,626

(22) Filed: Oct. 30, 2009

(65) Prior Publication Data

US 2011/0102509 A1 May 5, 2011

(51) Int. Cl.

| | |
|---|---|
| ***B41J 2/14*** | (2006.01) |
| ***B41J 2/16*** | (2006.01) |
| ***B21D 53/76*** | (2006.01) |

(52) U.S. Cl.
USPC ..... 347/47; 347/50; 29/890.1

(58) Field of Classification Search
USPC ..... 347/47, 50; 29/890.1
See application file for complete search history.

(56) References Cited

U.S. PATENT DOCUMENTS

| | | | | |
|---|---|---|---|---|
| 2003/0142172 | A1 | 7/2003 | Schmidt et al. | |
| 2009/0011185 | A1* | 1/2009 | Giri et al. | 428/136 |
| 2009/0179965 | A1* | 7/2009 | Hirosawa et al. | 347/50 |
| 2009/0309938 | A1* | 12/2009 | Yoneda | 347/85 |

* cited by examiner

*Primary Examiner* — Lisa M Solomon

(57) ABSTRACT

A fluid-ejection assembly includes a die, a substrate, ribs, and adhesive. The die has nozzles through which fluid is ejected. The substrate provides the fluid to the die. The ribs are within the substrate, and have rounded corners. The rounded corners are adapted to provide a predetermined characteristic. The adhesive affixes the die to the substrate.

15 Claims, 3 Drawing Sheets

FLUID-EJECTION ASSEMBLY SUBSTRATE HAVING ROUNDED RIBS

BACKGROUND

Fluid-ejection devices are used to eject fluid onto media and other surfaces. One common type of fluid-ejection device is an inkjet-printing device, such as an inkjet printer, which is used to eject ink onto media like paper to form images on the media. The component of the fluid-ejection device that actually ejects the fluid is a fluid-ejection assembly, which is commonly referred to as a printhead, such as an inkjet printhead in the case where the device is an inkjet-printing device. A fluid-ejection assembly is typically formed of at least two parts: a die that has a number of fluid-ejection nozzles through which the fluid is ejected as droplets, and a substrate affixed to the die to route the fluid to the die.

DETAILED DESCRIPTION

Figure 1:
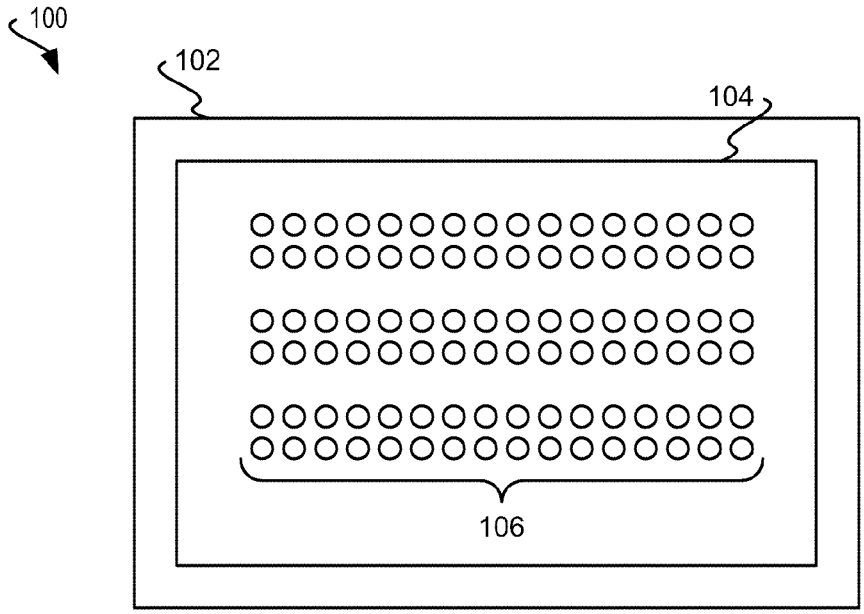
FIG. 1 is a diagram of a top view of a fluid-ejection assembly, according to an embodiment of the present disclosure.

As noted in the background section, a fluid-ejection assembly is the component of a fluid-ejection device that actually ejects fluid, and is typically formed of at least two parts: a die and a substrate. During manufacture of the fluid-ejection assembly, adhesive is typically employed to affix the die to the substrate. The die has a number of fluid slots that are each fluidically connected to a number of fluid-ejection nozzles of the die. The substrate has a number of ribs that define channels corresponding to the fluid slots of the die, such that fluid paths are defined from the channels of the substrate to their corresponding fluid slots of the die.

Adhesive is deposited, or dispensed, in the form of beads onto the ribs of the substrate, the die is placed onto this adhesive, and the adhesive is then typically cured to affix the die to the substrate. As these components have become smaller, the fluid slots of the die and the channels of the substrate have themselves become smaller in width and also closer together. However, the decreased widths of the fluid slots and the channels, and their placement closer together, can result in various problems occurring, owing to the adhesive deposited on the ribs of the substrate to affix the die to the substrate.

For example, one potential problem arises from the adhesive taking on a "bulged" or "squished" profile when the die is placed on the adhesive after the adhesive has been placed on the ribs of the substrate. As a result, the adhesive may at least partially block a fluid slot of the die. During subsequent usage of the fluid-ejection assembly, gaseous bubbles that are generated due to thermal decomposition of the fluid near the fluid-ejection nozzles can become entrapped by the bulged adhesive. Entrapment of gaseous bubbles can deleteriously affect fluid ejection by the die, such as by affecting image formation quality. In extreme situations, the adhesive may completely block a fluid slot of the die.

A limited solution in this respect is to dispense less adhesive to join the die and the substrate together to form the fluid paths between the die and the substrate. However, if insufficient adhesive is dispensed, the resulting adhesive bead may not be able to prevent leaks within the fluid paths. For example, if the adhesive beads are not tall enough, the adhesive will not properly come into contact with all locations along the surface of the die when the die is affixed to the substrate, such that corresponding fluid paths may not be properly isolated from one another. Fluid dispensed from one fluid slot of the substrate to a corresponding slot of the die may thus also or instead leak into a different slot of the die. In general, the adhesive beads are dispensed in sufficient volume so that they are sufficiently tall to prevent leaks from occurring within the fluid paths from the die to the substrate.

The inventors have developed a novel approach that mitigates the potential for these problems occurring. In particular, the inventors have discovered that purposefully rounding the corners of the substrate ribs inhibits the adhesive from taking on a "bulged" or squished profile when the die is subsequently placed on the adhesive after the adhesive has been placed on the ribs. As such, the potential for entrapment of gaseous bubbles by the adhesive during subsequent use of the fluid-ejection-ejection assembly is decreased, as is the potential for partially or completely blocking the fluid slots of the die.

Furthermore, the inventors have found that a lesser volume adhesive can be dispensed on such rounded ribs of the substrate to achieve leak-free fluid paths from the substrate to the die, as compared to dispensing adhesive beads on non-rounded corners. Although the adhesive beads are dispensed on rounded ribs in lesser volumes, they have been found to still be sufficiently tall to minimize the potential for leaks within the fluid path from the substrate to the die. Therefore, rounding the corners of the ribs of the substrate minimizes the potential for gaseous bubbles to be entrapped, while also still minimizing the potential for leaks to occur.

Figure 2:
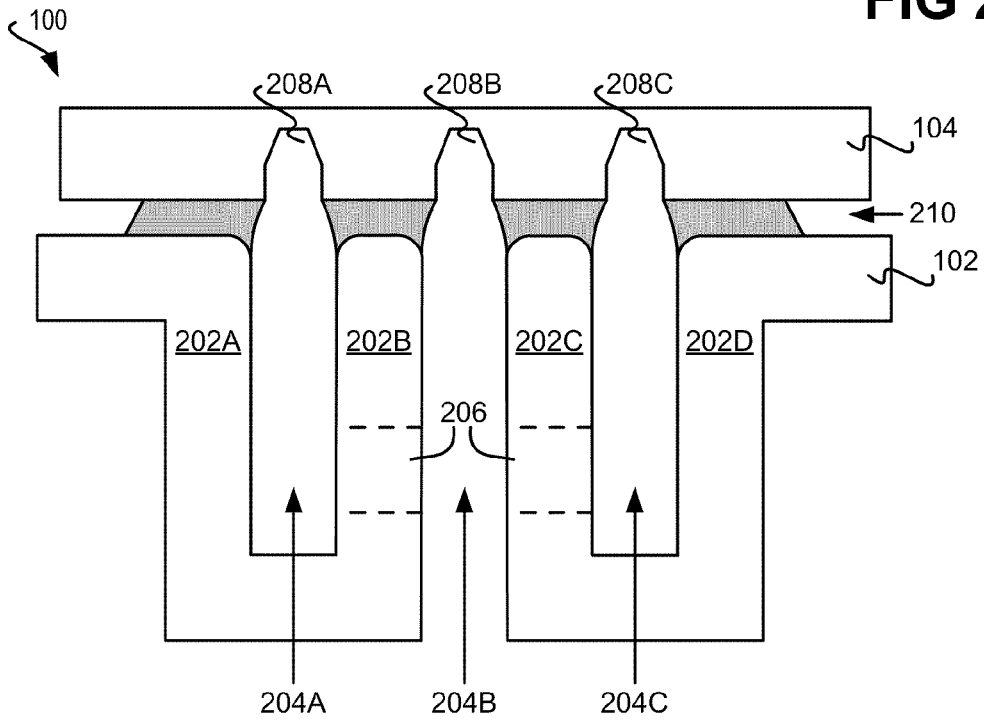
FIG. 2 is a diagram of a cross-sectional front view of a fluid-ejection assembly, according to an embodiment of the present disclosure.

FIGS. 1 and 2 show a top view and a cross-sectional front view, respectively, of a fluid-ejection assembly 100, according to an embodiment of the disclosure. The fluid-ejection assembly 100 includes a substrate 102 and a die 104. As depicted in FIG. 1, the die 104 has a number of fluid-ejection nozzles 106, through which fluid is ejected from the assembly 100. The fluid-ejection nozzles 106 are typically organized in a number of groups that are separated from one another and that each include one or more rows of the nozzles 106, as is depicted in FIG. 1.

As depicted in FIG. 2, the substrate 102 includes a number of ribs 202A, 202B, 202C, and 202D, collectively referred to as the ribs 202. The ribs 202 include outer ribs 202A and 202D and inner ribs 202B and 202C. While two inner ribs are depicted in FIG. 2, there can be as few as no inner ribs and as many as one or more inner ribs. The ribs 202 define a number of fluid channels 204A, 204B, and 204C, collectively referred to as the fluid channels 204. Each fluid channel is defined between two adjacent ribs. Inter-fluid channel passages 206 fluidically interconnect the fluid channels 204.

As depicted in FIG. 2, the die 104 includes a number of fluid slots 208A, 208B, and 208C, collectively referred to as the fluid slots 208. The fluid slots 208 correspond in number to the fluid channels 204 of the substrate 102 in a one-to-one manner. For instance, the fluid slot 208A corresponds to the fluid channel 204A, the fluid slot 208B corresponds to the fluid channel 204B, and so on. The fluid slots 208 are fluidically coupled to the fluid-ejection nozzles 106, which is not depicted in FIGS. 1 and 2. Fluid is thus provided from the substrate 102 to the die 104 via the fluid channels 204 providing fluid to the fluid slots 208 via fluid paths defined between the fluid channels 204 and their corresponding fluid slots 208. The fluid-ejection nozzles 106 then eject the fluid as droplets.

As depicted in FIG. 2, the die 104 is affixed to the substrate 102. Specifically, adhesive 210 is deposited on the substrate 102 and then the die 104 is placed on the adhesive 210 to affix the die 104 to the substrate 102. More specifically, the adhesive 210 is deposited on the ribs 202 of the substrate 102 and then the die 104 is placed on the adhesive 210 to affix the die 104 to the ribs 202 of the substrate 102.

Figure 3A:
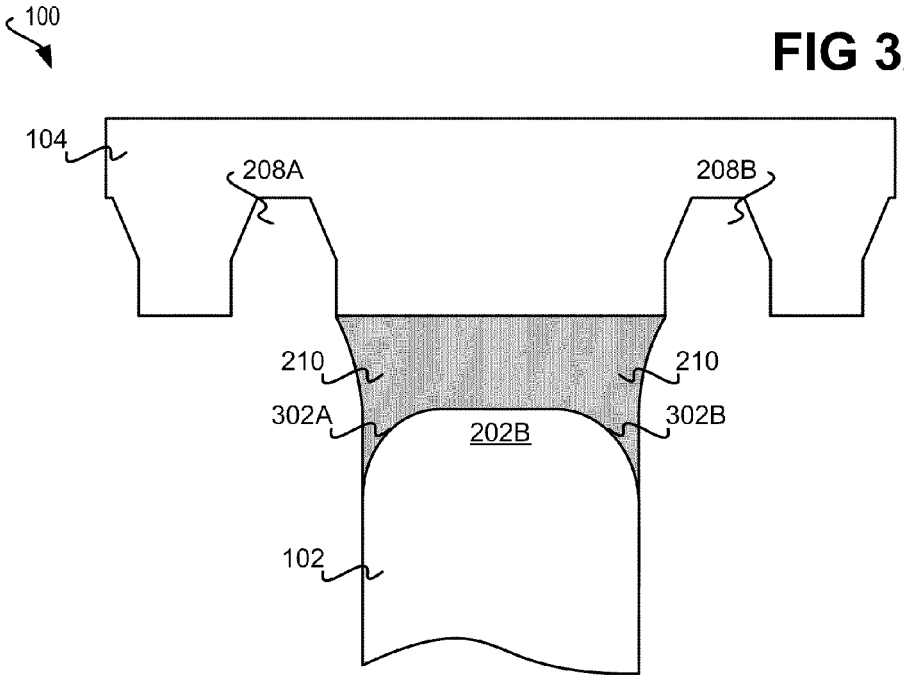
FIG. 3A is a diagram of a portion of the cross-sectional front view of the fluid-ejection assembly of FIG. 2 in detail, according to an embodiment of the present disclosure.

FIG. 3A shows a portion of the fluid-ejection assembly 100 in detail, in which the rib 202B of the substrate 102 as affixed to the die 104 via the adhesive 210 is depicted in more detail, as representative of all the ribs 202, according to an embodiment of the disclosure. The rib 202B has rounded corners 302A and 302B, collectively referred to as the rounded corners 302. While the inner ribs 202B and 202C each have two such corners, the outer ribs 202A and 202D each have one such corner.

The corners 302 are purposefully rounded. This means that the rib 202B of the substrate 102 is fabricated so that the corners 302 are rounded on purpose, as opposed to the corners 302 being accidentally rounded as a result of the fabrication process of the substrate 102. The rounded corners 302 are further purposefully rounded in that they have a selected radius of curvature. Specifically, for the rounded corners 302 to provide certain advantages as are described later in the detailed description (i.e., so that they are adapted to provide certain predetermined characteristics that are described later in the detailed description), the selected radius of curvature of the corners 302 is chosen in one embodiment so that the ratio of this selected radius to the width of the rib 202B is between 1:12 and 3:10.

Figure 3B:
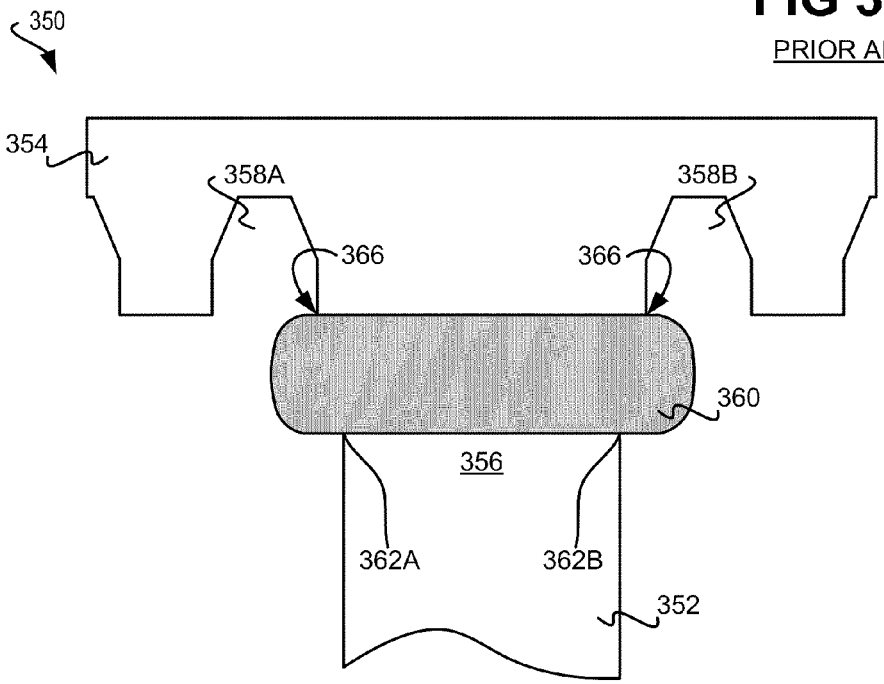
FIG 3B PRIOR ART
FIG. 3B is a diagram of a corresponding portion of a cross-sectional front view of a fluid-ejection assembly within the prior art, in detail.

FIG. 3B by comparison shows a portion of a fluid-ejection assembly 350 in detail, in which a rib 356 of a substrate 352 as affixed to a die 354 via adhesive 360 is specifically depicted in detail, according to the prior art. The rib 356 has squared corners 362A and 362B, collectively referred to as the squared corners 362. The corners 362 are squared as is conventional within the prior art. Certain advantages and aspects associated with the rounded corners 302 of FIG. 3A are now described in comparison to the squared corners 362 of FIG. 3B.

In FIG. 3A, the rounded corners 302 of the rib 202B are believed to promote migration of the adhesive 210 down the side surfaces of the rib 202B upon deposition of the adhesive 210 onto the rib 202B and upon placement of the die 104 onto the adhesive 210. As such, this promotion of migration of the adhesive 210 is a predetermined characteristic that the rounded corners 302 of the 202B are adapted to provide. The rounded corners 302 of the rib 202B are believed to not present any barrier to fluidic capillary or wicking flow of the adhesive 210 down the side surfaces of the rib 202B upon deposition of the adhesive 210 onto the rib 202B and upon placement of the die 104 onto the adhesive 210. That the rounded corners 302 of the rib 202B do not present any barrier to such fluidic capillary or wicking flow of the adhesive 210 is another predetermined characteristic that the rounded corners 302 are adapted to provide.

Furthermore, the rounded corners 302 of the rib 202B are also believed to not present any barrier to inertial flow of the adhesive 210 down the side surfaces of the rib 202, as a result of the die 104 exerting a force onto the adhesive 210 when placed on the adhesive 210, which is a further predetermined characteristic that the rounded corners 302 are adapted to provide. The rounded corners 302 of the rib 202B thus are believed to inhibit the adhesive 210 from bulging out perpendicular to the side surfaces of the rib 202B. This is another predetermined characteristic that the rounded corners 302 of the rib 202B are adapted to provide.

By comparison, in FIG. 3B, the squared corners 362 of the rib 356 are believed to inhibit migration of the adhesive 360 down the side surfaces of the rib 356 upon deposition of the adhesive 360 onto the rib 356 and upon placement of the die 354 onto the adhesive 360. That is, the squared corners 362 of the rib 356 are believed to present a barrier to fluidic capillary or wicking flow of the adhesive 360 down the side surfaces of the rib 356 upon deposition of the adhesive 360 onto the rib 356 and upon placement of the die 354 onto the adhesive 360. The squared corners 362 of the rib 356 thus are believed to promote bulging out of the adhesive 360 perpendicular to the side surfaces of the rib 356. This results from the squared corners 362 pinning the adhesive 360 so that the adhesive 360 cannot flow down the side surfaces of the rib 356, which instead results in the adhesive 360 bulging out perpendicular to these side surfaces of the rib 356.

As a result, in FIG. 3A, the adhesive 210 is inhibited from at least partially blocking the fluid slots 208 upon deposition of the adhesive 210 onto the rib 202B and upon placement of the die 104 onto the adhesive 210. By comparison, in FIG. 3B, the adhesive 360 at least partially blocks fluid slots 358A and 358B (collectively referred to as the fluid slots 358) of the die 354 upon deposition of the adhesive 360 onto the rib 356 and upon placement of the die 354 onto the adhesive 360. Therefore, in FIG. 3A, the adhesive 210 has a profile that inhibits entrapment of gas bubbles during usage of the fluid-ejection assembly 100, whereas in FIG. 3B, the adhesive has a profile that promotes entrapment of gas bubbles during usage of the fluid-ejection assembly 350.

For example, during usage of the fluid-ejection assemblies 100 and 350, the dies 104 and 354 are typically positioned below the substrates 102 and 352, such that the assemblies 100 and 350 are upside-down as compared to as is shown in FIGS. 3A and 3B. As the dies 104 and 354 eject fluid, gas in the form of gaseous bubbles may be introduced into the fluid slots 208 and 358 of the fluid-ejection assemblies 100 and 350. In FIG. 3A, the tapered profile of the adhesive 210 is such that these gaseous bubbles do not become entrapped. As such, inhibiting entrapment of gaseous bubbles during usage is a predetermined characteristic that the rounded corners of the rib are adapted to provide. By comparison, in FIG. 3B, the bulging or squished profile of the adhesive 360 is such that these gaseous bubbles can become entrapped at locations 366. Gaseous bubble entrapment is undesirable, because it can affect the ability of a fluid-ejection assembly to properly eject fluid, and thus can impair image quality in the case where the fluid-ejection device in question is an inkjet-printing device.

In both FIGS. 3A and 3B, for proper fluid delivery from the substrates 102 and 352 to the dies 104 and 354 to occur, the dies 104 and 354 are positioned at a specified distance from the substrates 102 and 352. To affix the dies 104 and 354 to the substrates 102 and 352, beads of adhesive 210 and 360 are first placed on the ribs 202B and 356 (as well as on the other ribs of the fluid-ejection assemblies 100 and 350). The dies 104 and 354 are then placed on the adhesive 210 and 360, as depicted in FIGS. 3A and 3B.

The adhesive 210 has a bead height, which is the height of the individually deposited bead of the adhesive 210 on the rib 202B. Likewise, the adhesive 360 has a bead height, which is the height of the initially deposited bead of the adhesive 360 on the rib 356. The bead heights are selected so that when the dies 104 and 354 are placed on the adhesive 210 and 360 to affix the dies 104 and 354 to the substrates 102 and 352, the dies 104 and 354 are at the specified distance from the substrates 102 and 352, and so that no leaks develop within the fluid paths between the dies 104 and 354 and the substrates 102 and 352.

Specifically, the size and shape of the die and the substrate normally vary by nominally small amounts during the manufacture and assembly processes. When the die and the substrate are brought together during the assembly process, the distance between them may vary along the surfaces of the die and the substrate. As such, if an adhesive bead having a relatively low bead height is dispensed onto the substrate and the die then joined to the substrate, the adhesive may not come into contact at all the intended locations along the surface of the die, resulting in leaks between fluid slots or between fluid slots and the outside atmosphere. Therefore, an adhesive bead desirably has a sufficiently high bead height to increase the likelihood that no leaks will develop between the die and the substrate.

For a given volume of adhesive 210 deposited on the rib 202B having rounded corners 302, as in FIG. 3A, the inventors have discovered that the bead height is higher as compared to when this same volume of adhesive 360 is deposited on the rib 356 having squared corners 362, as in FIG. 3B. Stated another way, for the adhesive 210 and 360 to both have a desired bead height, the inventors have discovered that a lesser volume of the adhesive 210 has to be deposited on the rib 202B having rounded corners 302, as in FIG. 3A, as compared to the volume of adhesive 360 that has to be deposited on the rib 356 having squared corners 362, as in FIG. 3B. Depositing a lesser volume of the adhesive is desirable, because it lessens the potential for the adhesive to bulge out perpendicular to the side surfaces of the ribs and/or to at least partially block the fluid slots of the die.

As such, in FIG. 3A a lesser volume of adhesive 210 has to be deposited to ensure a desired bead height that minimizes the potential for leaks to develop within the fluid paths, as compared to the volume of adhesive 360 that has to be deposited in FIG. 3B to ensure this same bead height. Therefore, the potential for leaks is minimized in FIG. 3A while also minimizing the potential for the adhesive to entrap gaseous bubbles, whereas in FIG. 3B decreasing the potential for leaks results in increasing the potential for the gaseous bubbles to become entrapped.

Figure 4:
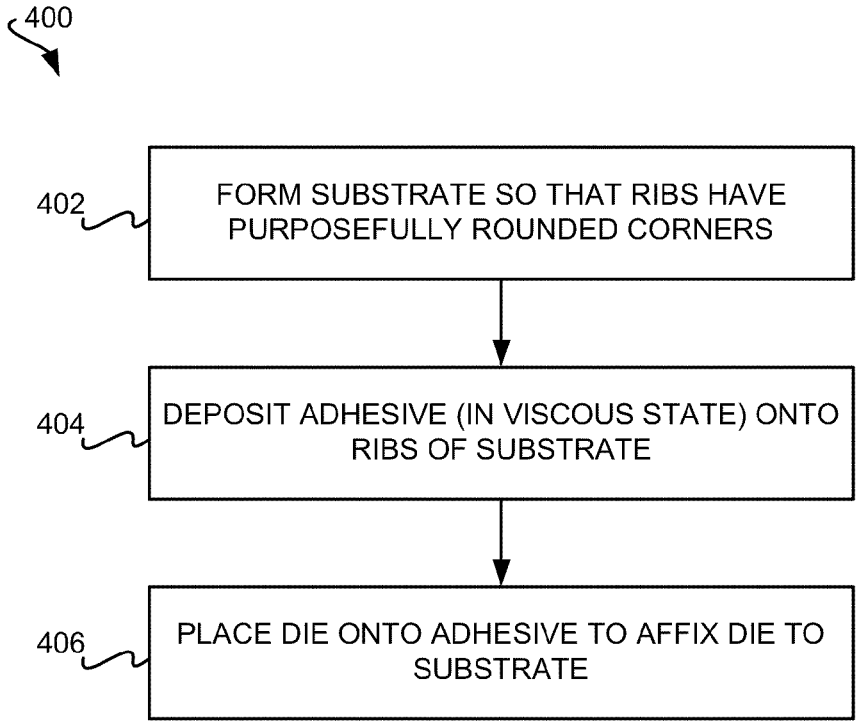
FIG. 4 is a flowchart of a method to fabricate a fluid-ejection assembly, according to an embodiment of the present disclosure.

FIG. 4 shows a method 400, according to an embodiment of the disclosure. The substrate 102 is formed so that the ribs 202 have purposefully rounded corners (402). For example, the substrate 102 may be fabricated from plastic, or another type of material, such as ceramic, glass, metal, and so on. A mold of the substrate 102 may be fabricated in which the areas of the mold corresponding to the corners of the ribs 202 are rounded. The desired material is then heated to enter a liquid state and is poured into the mold. When the material cools, it hardens to enter a solid state, and is removed from the mold. The corners of the ribs 202 may also be purposefully rounded in other ways. For instance, if the ribs 202 initially have squared corners, they may be rounded by machining, bead-blasting, chemical etching, by another approach.

The adhesive 210 is deposited in a viscous state in the form of beads onto the ribs 202 of the substrate 102 (404). The adhesive 210 may be an epoxy, such as a two-part epoxy in one embodiment, or another type of adhesive. The die 104 is then placed onto the adhesive 210 to affix the die 104 to the substrate 102 (406). The adhesive 210 at least substantially transitions to a solid state after it has been deposited onto the ribs 202 of the substrate 102, and after the die 104 has been placed onto the adhesive 210. In one embodiment, this transition to a solid state may be achieved by curing the adhesive 210, such as by employing heat or ultraviolet (UV) light.

Figure 5:
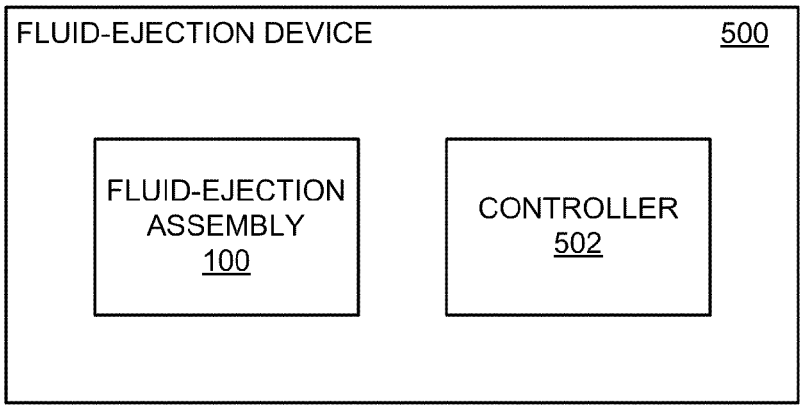
FIG. 5 is a block diagram of a rudimentary fluid-ejection device, according to an embodiment of the present disclosure.

In conclusion, FIG. 5 shows a block diagram of a rudimentary fluid-ejection device 500, according to an embodiment of the disclosure. The fluid-ejection device 500 includes the fluid-ejection assembly 100, and a controller 502, which may be implemented in software, hardware, or a combination of software and hardware. The controller 502 causes (i.e., controls) ejection of fluid from the fluid-ejection device 500 by the fluid-ejection assembly 100 as desired.

In the embodiment of FIG. 5, the fluid-ejection assembly 100 is depicted as including a housing 504. The housing 504 contains a supply of fluid 506, which is provided by a substrate to a die for ejection through nozzles of the die, as has been described. Therefore, the housing 504 includes the substrate.

It is finally noted that the fluid-ejection device 500 may be an inkjet-printing device, which is a device, such as a printer, that ejects ink onto media, such as paper, to form images, which can include text, on the media. The fluid-ejection device 500 is more generally a fluid-ejection precision-dispensing device that precisely dispenses fluid, such as ink. The fluid-ejection device 500 may eject pigment-based ink, dye-based ink, another type of ink, or another type of fluid. Examples of other types of fluid include those having water-based or aqueous solvents, as well as those having non-water-based or non-aqueous solvents. Embodiments of the disclosure can thus pertain to any type of fluid-ejection precision-dispensing device that dispenses a substantially liquid fluid.

A fluid-ejection precision-dispensing device is therefore a drop-on-demand device in which printing, or dispensing, of the substantially liquid fluid in question is achieved by precisely printing or dispensing in accurately specified locations, with or without making a particular image on that which is being printed or dispensed on. The fluid-ejection precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids thus include drugs, cellular products, organisms, fuel, and so on, which are not substantially or primarily composed of gases such as air and other types of gases, as can be appreciated by those of ordinary skill within the art.

We claim:

1. A fluid-ejection assembly comprising:

a die having a plurality of nozzles through which fluid is ejectable, and having a plurality of fluid slots fluidically coupled to the nozzles;

a substrate to provide the fluid to the die;

a plurality of ribs within the substrate, the ribs defining a plurality of channels providing the fluid to the fluid slots, the ribs having rounded corners that each have a preselected radius, the rounded corners providing a predetermined characteristic; and, adhesive on the ribs affixing the die to the substrate, wherein the predetermined characteristic comprising inhibiting the adhesive from at least partially blocking the fluid slots.

2. The fluid-ejection assembly of claim 1, wherein the the preselected ratio of each rib is such that a ratio of the preselected radius to a width of each rib is between 1:12 and 3:10.

3. The fluid-ejection assembly of claim 1, wherein the predetermined characteristic is promoting migration of the adhesive down side surfaces of the ribs.

4. The fluid-ejection assembly of claim 1, wherein the predetermined characteristics comprise inhibiting the adhesive bulging out perpendicular to the side surfaces of the ribs.

5. The fluid-ejection assembly of claim 1, wherein the fluid slots are lesser in number than the nozzles, such that each fluid slot is fluidically coupled to a subset of the nozzles, wherein the channels correspond in number to the fluid slots of the die, and each channel provides the fluid to a corresponding fluid slot.

6. The fluid-ejection assembly of claim 1, wherein the predetermined characteristics comprise presenting no barrier to fluidic capillary or wicking flow of the adhesive down side surfaces of the ribs.

7. The fluid-ejection assembly of claim 1, wherein the predetermined characteristics comprise causing the adhesive to have a profile between the ribs and the die that inhibits entrapment of gaseous bubbles during usage of the fluid-ejection assembly.

8. The fluid-ejection assembly of claim 1, wherein the fluid-ejection assembly is an inkjet printhead assembly for an inkjet-printing device.

9. A fluid-ejection assembly comprising:

a die having a plurality of nozzles through which fluid is ejectable, and having a plurality of fluid slots fluidically coupled to the nozzles;

a substrate to provide the fluid to the die;

a plurality of ribs within the substrate, the ribs defining a plurality of channels providing the fluid to the fluid slots, the ribs having predetermined rounded corners that each have a preselected radius, the rounded corners providing a predetermined characteristic; and, adhesive on the ribs affixing the die to the substrate, wherein the predetermined characteristic comprises inhibiting the adhesive from at least partially blocking the fluid slots.

10. The fluid-ejection assembly of claim 9, wherein the the preselected ratio of each rib is such that a ratio of the preselected radius to a width of each rib is between 1:12 and 3:10.

11. The fluid-ejection assembly of claim 9, wherein the fluid slots are lesser in number than the nozzles, such that each fluid slot is fluidically coupled to a subset of the nozzles, wherein the channels correspond in number to the fluid slots of the die, and each channel provides the fluid to a corresponding fluid slot.

12. The fluid-ejection assembly of claim 9, further comprising a housing containing a supply of the fluid, wherein the housing includes the substrate.

13. The fluid-ejection assembly of claim 9, wherein the fluid-ejection assembly is an inkjet printhead assembly for an inkjet-printing device.

14. The fluid-ejection assembly of claim 1, wherein the rounded corners of the ribs are purposefully and desirably rounded, as opposed to being accidentally and undesirably rounded during fabrication of the substrate.

15. The fluid-ejection assembly of claim 1, wherein all the ribs within the substrate have the rounded corners, such that any corner of any rib of the substrate is rounded.

* * * * *

UNITED STATES PATENT AND TRADEMARK OFFICE

CERTIFICATE OF CORRECTION

PATENT NO. : 8,573,741 B2
APPLICATION NO. : 12/609626
DATED : November 5, 2013
INVENTOR(S) : Alok Sharan et al.

It is certified that error appears in the above-identified patent and that said Letters Patent is hereby corrected as shown below:

In the Claims

In column 7, line 1, in Claim 2, delete “the the” and insert -- the --, therefor.

In column 8, line 10, in Claim 10, delete “the the” and insert -- the --, therefor.

Signed and Sealed this
Eleventh Day of February, 2014

Michelle K. Lee

Michelle K. Lee
*Deputy Director of the United States Patent and Trademark Office*